US011352116B1

(12) United States Patent
Amerling et al.

(10) Patent No.: US 11,352,116 B1
(45) Date of Patent: Jun. 7, 2022

(54) MARINE DRIVES HAVING A RECOIL STARTER

(71) Applicant: Brunswick Corporation, Mettawa, IL (US)

(72) Inventors: Steven J. Amerling, Fond du Lac, WI (US); Timothy J. Eddy, Oshkosh, WI (US); David B. Griep, Rubicon, WI (US); Thomas C. Groneng, Malone, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 17/073,562

(22) Filed: Oct. 19, 2020

(51) Int. Cl.
*B63H 20/32* (2006.01)
*F02B 61/04* (2006.01)
*F02N 3/02* (2006.01)

(52) U.S. Cl.
CPC ..... *B63H 20/32* (2013.01); *F02B 61/045* (2013.01); *F02N 3/02* (2013.01)

(58) Field of Classification Search
CPC ..... B63H 20/32; F02B 61/045; F02N 3/02
See application file for complete search history.

(56) References Cited

U.S. PATENT DOCUMENTS 3,358,668 A 12/1967 Post et al.
3,773,010 A 11/1973 Elingsen
4,348,194 A 9/1982 Walsh
4,955,836 A 9/1990 Suzuki
5,064,393 A 11/1991 Inoue
5,256,091 A * 10/1993 Haman ..... F02N 3/02 440/85
5,988,132 A * 11/1999 Watanabe ..... F02B 61/045 123/185.2
6,821,170 B2 * 11/2004 Sanschagrin ..... F02B 61/045 440/77
7,066,130 B2 6/2006 Purdy et al.

OTHER PUBLICATIONS

Mercury Marine, Propulsion Brochure, accessed Mar. 2, 2020 via MercuryMarine.com.

* cited by examiner

*Primary Examiner* — Stephen P Avila
(74) *Attorney, Agent, or Firm* — Andrus Intellectual Property Law, LLP

(57) ABSTRACT

A marine drive has a powerhead and a cowling enclosing the powerhead. The cowling comprises a first cowl portion and a second cowl portion coupled to the first cowl portion and being movable with respect to the first cowl portion into and between a closed cowl position in which the powerhead is enclosed by the cowling and an open cowl position in which the powerhead is accessible. A recoil starter is for starting the marine drive. The recoil starter extends through the second cowl portion and comprises a pull-start handle coupled to the marine drive via a recoil cable. Manually pulling the pull-start handle out of a recoiled position with respect to the marine drive causes the marine drive to start. The pull-start handle is also movable into an offset position, in which the second cowl portion is freely movable into and out of the open and closed cowl positions.

20 Claims, 10 Drawing Sheets

MARINE DRIVES HAVING A RECOIL STARTER

FIELD

The present disclosure relates to marine drives, and more particularly to marine drives having a cowling and a recoil starter that extends through the cowling.

BACKGROUND

The following U.S. patents are incorporated herein by reference:

U.S. Pat. No. 7,066,130 discloses a recoil starter having a guide surface with limited polar symmetry about the axis of the pull-rope, limiting rotational orientation of the pull-handle in the at-rest position to less than three angular positions.

U.S. Pat. No. 4,348,194 discloses a cowl for the powerhead of an outboard motor, including two bottom cowl members attached together by screws which also mount a latch bracket and a hinge member. The latch bracket supports a latch mechanism which, with the hinge member serves to hold a top cowl member in place.

U.S. Pat. No. 3,773,010 discloses a cowl for an outboard motor comprising two members having their rear portions hingedly connected to each by a common abutting member. Each of the hinges on the common abutting member has a tapered element extending therefrom for disposition in a cooperating tapered hole in a frame supported by the engine to provide support of the members on the engine. The front portions of the two members are spaced from each other to provide ready access to all adjustments of the engine by mere removal of a front shield, which closes the space between the two members. The front portions of the two members are release-ably connected to each other by latches.

U.S. Pat. No. 3,358,668 discloses an outboard motor having a power unit including an engine at the upper end of the unit, a cowl support frame assembly, a resilient mounting means disposed on the power unit and supporting the frame assembly, and a cowl carried by the frame assembly and enclosing the engine. The frame assembly and cowl are spaced from the power unit by said resilient mounting means to vibrationally isolate the cowl from the power unit.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In non-limiting examples disclosed herein, a marine drive has a powerhead and a cowling enclosing the powerhead. The cowling comprises a first cowl portion and a second cowl portion coupled to the first cowl portion and being movable with respect to the first cowl portion into and between a closed cowl position in which the powerhead is enclosed by the cowling and an open cowl position in which the powerhead is accessible. A recoil starter is for starting the marine drive. The recoil starter extends through the second cowl portion and comprises a pull-start handle coupled to the marine drive via a recoil cable. Manually pulling the pull-start handle out of a recoiled position with respect to the marine drive causes the marine drive to start.

The pull-start handle is also movable into an offset position, in which the second cowl portion is freely movable into and out of the open and closed cowl positions. Movement of the second cowl portion from the closed cowl position to the open cowl position when the pull-start handle is in the recoiled position causes the pull-start handle to move into and thereafter remain in the offset position, thus permitting subsequent movement of the second cowl portion back into the closed cowl position.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

During research and development, the present inventors determined that conventional cowlings for marine drives, and particularly cowlings for smaller-sized outboard motors, often have cowl retention means that can be time-consuming and difficult to operate. This is especially true for outboard motors having a recoil starter that extends through the cowling, wherein the user is required to undertake multiple actions to open and/or close the cowling. The present disclosure is a result of the inventors' efforts to overcome these and other disadvantages of the prior art.

Figure 1:
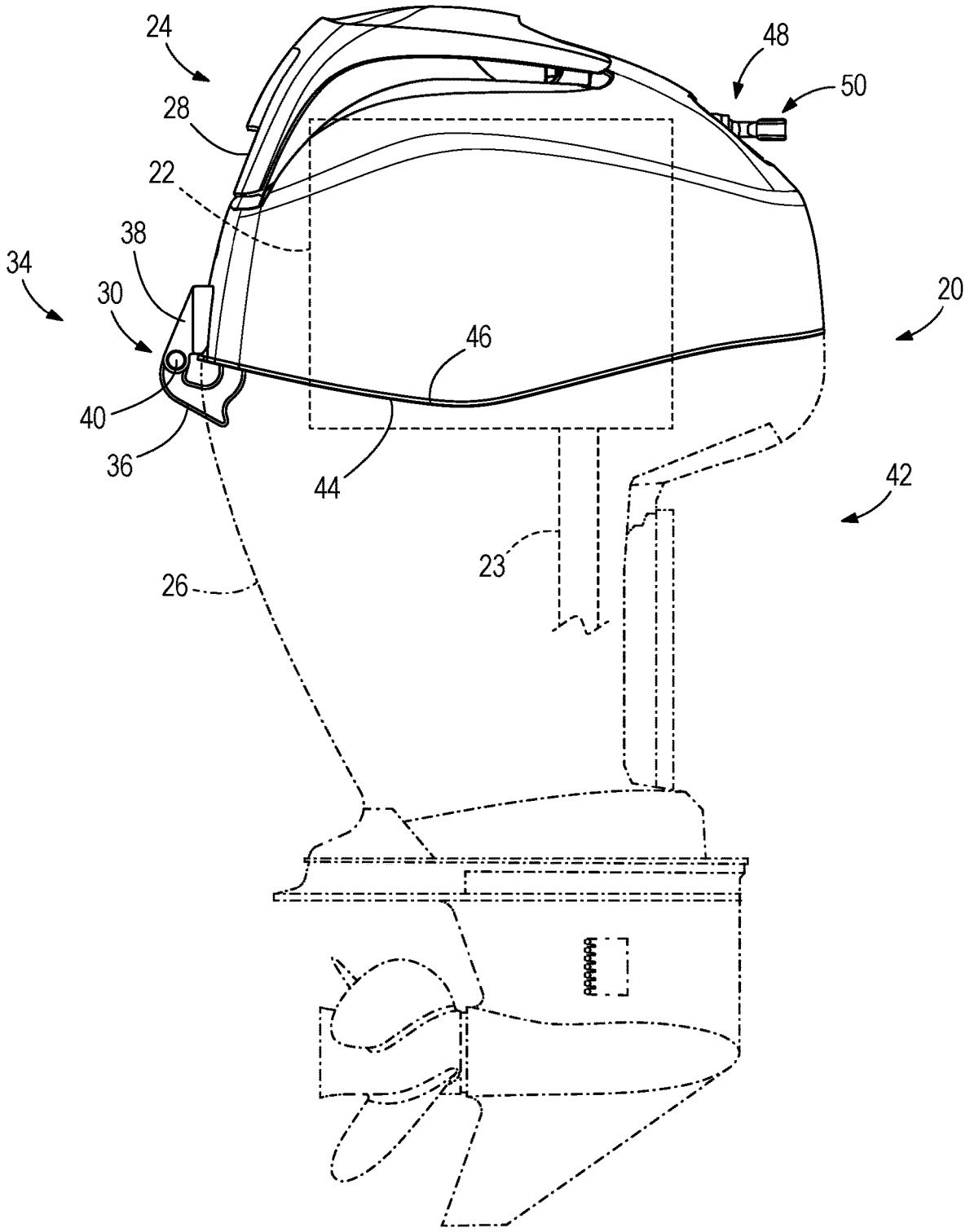
FIG. 1 is a side view of an outboard motor having a powerhead and lower and upper cowl portions enclosing the powerhead.

FIG. 1 illustrates a marine drive, which in the illustrated example is an outboard motor 20. The outboard motor 20 includes a powerhead 22, which for example can be an internal combustion engine or similar means for providing a force for propelling a marine vessel in water, via for example driveshaft 23 extending downwardly from the powerhead 22. A cowling 24 surrounds the powerhead 22 and includes at least a first, lower cowl portion 26 and a second, upper cowl portion 28. In the illustrated example, the lower cowl portion 26 includes the portions of the cowling 24 extending below the powerhead 22 and the upper cowl portion 28 includes the portions of the cowling 24 extending over the top of the powerhead 22; however it should be recognized that the orientation and configuration of the respective lower and upper cowl portions 26, 28 can vary from what is shown. Referring to FIGS. 9-13, the upper cowl portion 28 is pivotably coupled to the lower cowl portion 26 and is pivotable into and between a closed cowl position (FIG. 9) and an open cowl position (FIG. 13). When viewed in series, FIGS. 9-13 illustrate movement of the upper cowl portion 28 from the closed cowl position to the open cowl position. It should be recognized that the cowling 24 shown in the drawings is exemplary, and the particular way in which the lower and upper cowl portions 26, 28 are coupled together and move with respect to each other can vary from what is shown, and for example the manner in which the upper cowl portion 28 is movable with respect to the lower cowl portion 26 can vary from what is shown.

In the illustrated example, the lower and upper cowl portions 26, 28 are coupled together by a hinge mechanism 30, which facilitates the above-described pivoting movement of the upper cowl portion 28 into and out of the closed and open cowl positions. The hinge mechanism 30 is located on an aftward side 34 of the outboard motor 20 and includes a first hinge bracket 36 fixed to the lower cowl portion 26 and a second hinge bracket 38 fixed to the upper cowl portion 28. The first and second hinge brackets 36, 38 are pivotably connected via a pivot shaft 40 extending along and thus defining pivot axis. Although not shown, the opposite, forward side 42 of the outboard motor 20 can also include one or more conventional latching mechanisms for securely latching the upper cowl portion 28 to the lower cowl portion 26 in the closed cowl position shown in FIG. 9. One type of a suitable latching mechanism is referred to in the art as a "lunch-box latch"; however other types of latching mechanisms could be employed. Location of the noted latching mechanism on the forward side 42 of the outboard motor 20 advantageously facilitates manual access by a user located in the associated marine vessel. The lower and upper cowl portions 26, 28 have lower and upper perimeters 44, 46, respectively, which are mated together so as to enclose the powerhead 22 when the lower and upper cowl portions 26, 28 are positioned in the closed cowl position. One or more perimeter seals (not shown) can be located along one or both of the respective upper and lower perimeters 44, 46 to provide a seal which for example prevents water intrusion when the latching mechanism is latched, i.e., in the closed cowl position.

Figure 2:
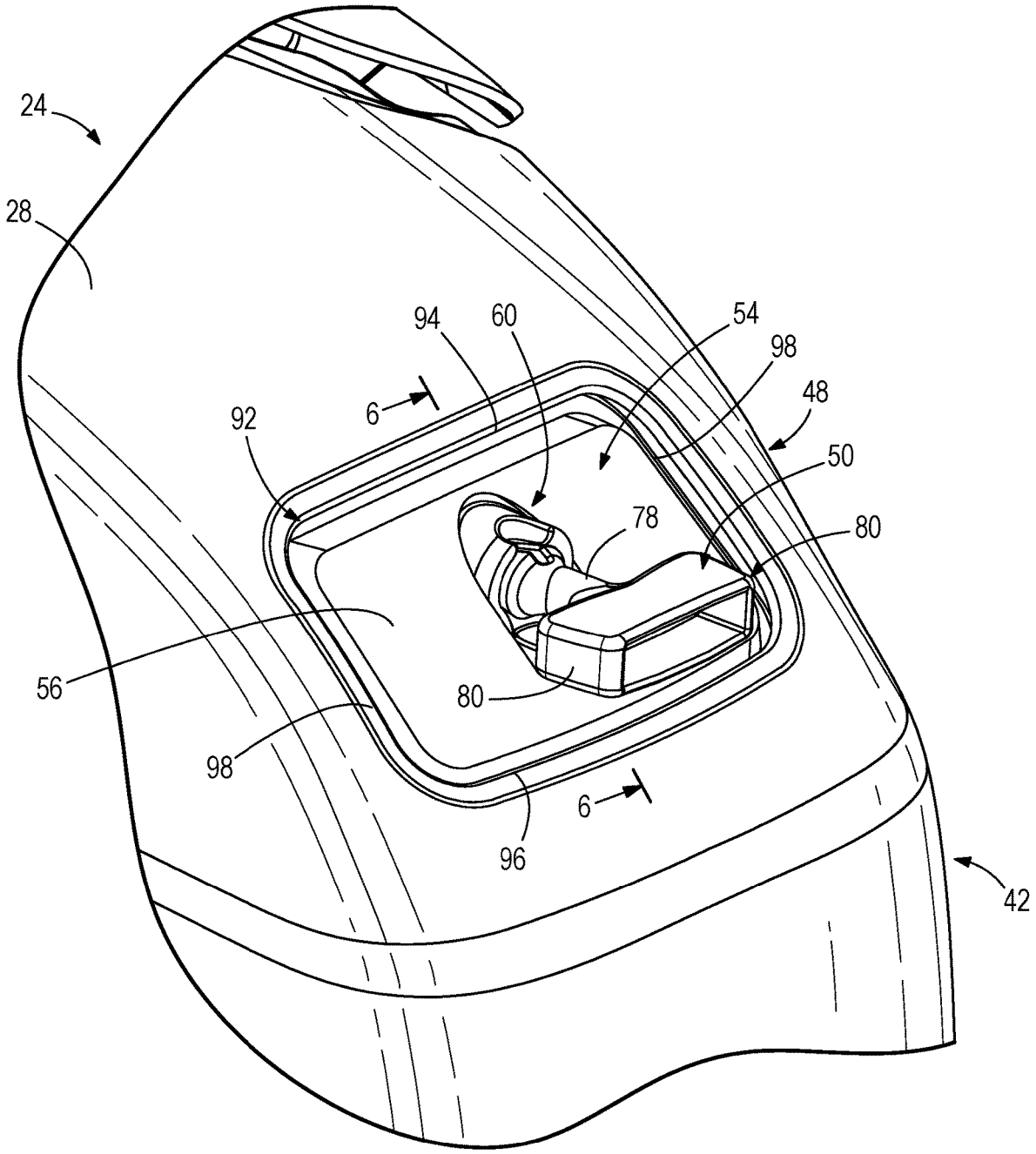
FIG. 2 is a front perspective view of an upper cowl portion and a recoil starter for starting the powerhead.
Figure 3:
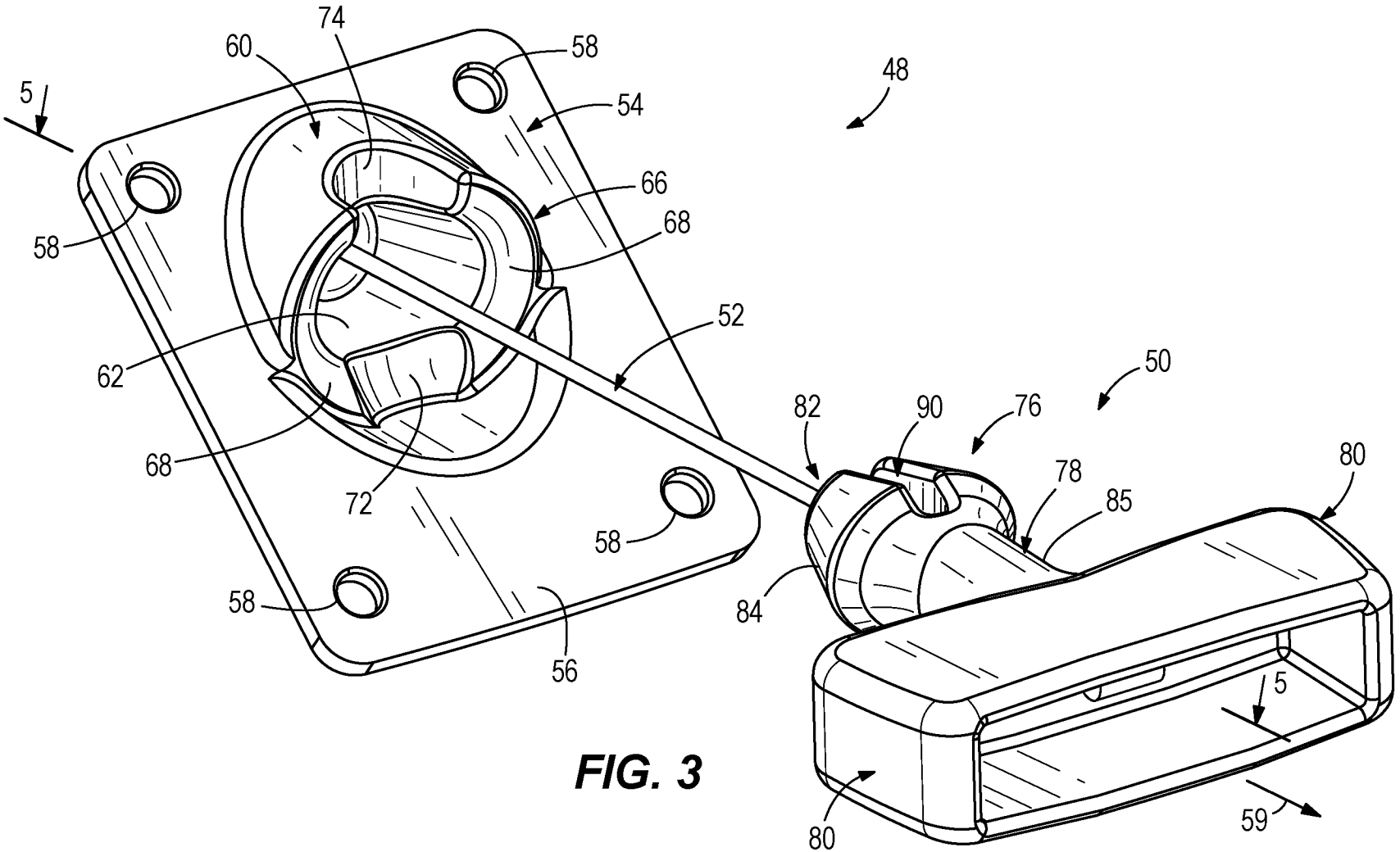
FIG. 3 is an isolated perspective view of the recoil starter.

Referring to FIGS. 2-5, the present disclosure provides the outboard motor 20 with a novel cowling 24 and recoil starter 48. In the illustrated example, the recoil starter 48 has a pull-start handle 50, which is coupled to the outboard motor 20 via a recoil cable 52. The recoil cable 52 has a first end 53 fixed to the pull-start handle 50 and an opposite, second end 55 coupled to the outboard motor 20, for example to the powerhead 22 and/or an underlying adapter plate and/or any similar fixed structure on the outboard motor 20 via a conventional recoil mechanism (not shown). Recoil mechanisms are well-known in the art and are configured to automatically apply a recoil force on the recoil cable 52 and pull-start handle 50, which permits the pull-start handle 50 to be pulled away from the outboard motor 20 to initiate starting of the powerhead 22, but yet continuously pulls the recoil cable 52 and pull-start handle 50 back towards outboard motor 20 so that the pull-start handle 50 is returned towards the outboard motor 20 when it is manually released. Conventional recoil mechanisms often have one or more springs for continuously applying the recoil force. Suitable recoil mechanisms for use with the present invention are widely commercially available. Reference is also made to the above-incorporated U.S. patents for further description of conventional recoil mechanisms and the manner in which such recoil mechanisms facilitate starting of an internal combustion engine. Referring to FIGS. 2 and 3, manually pulling the pull-start handle 50 away from the position shown in FIG. 2, see for example arrow 59 in FIG. 3, against the biasing recoil force provided by the recoil mechanism, causes the recoil mechanism to initiate starting of the powerhead 22. Manually releasing the pull-start handle 50 permits the recoil mechanism to automatically pull the recoil cable 52 back towards the outboard motor 20 until the pull-start handle 50 is returned to the position shown in FIG. 2.

Figure 4:
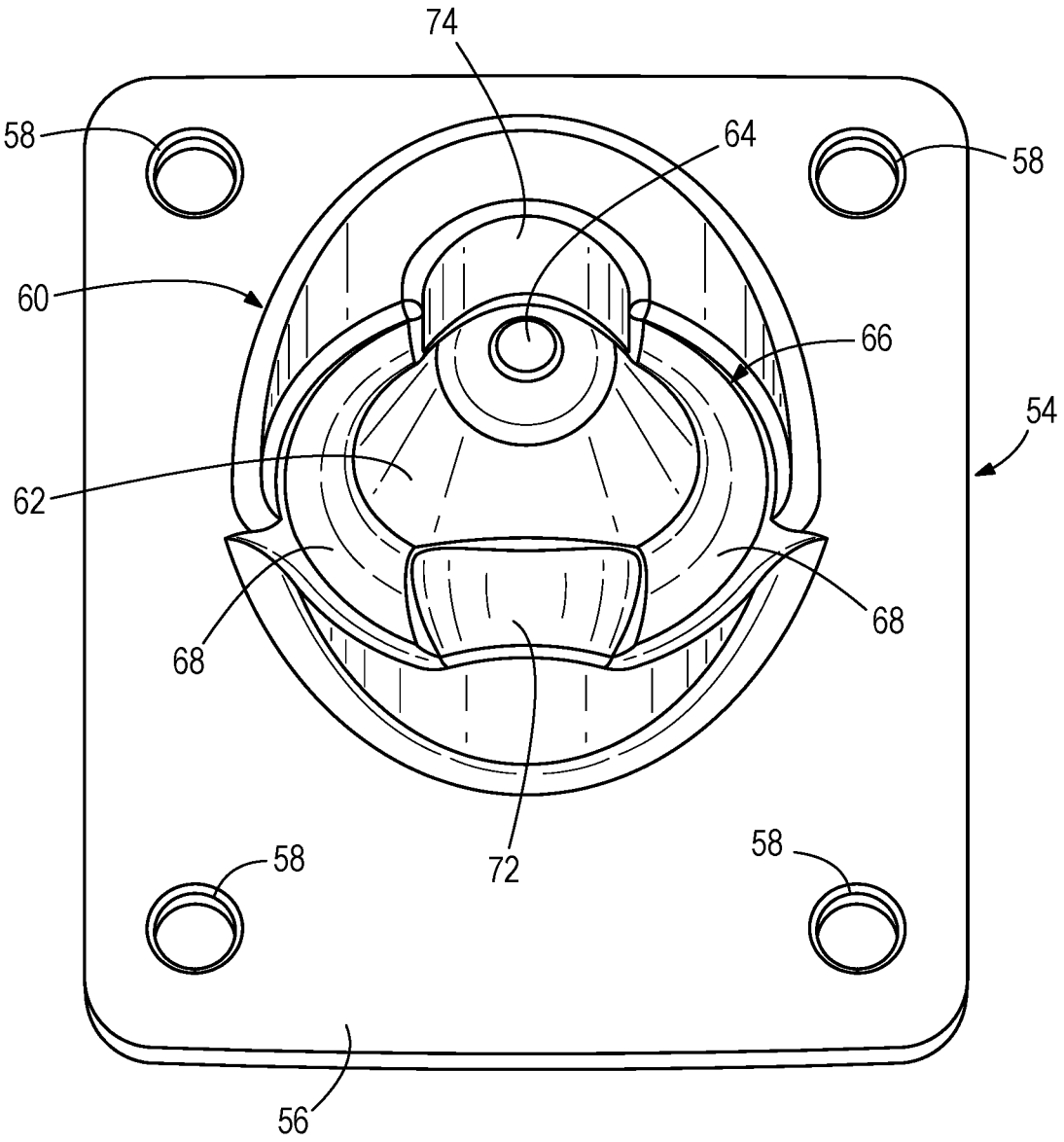
FIG. 4 is a front view of a base of the recoil starter.
Figure 5:
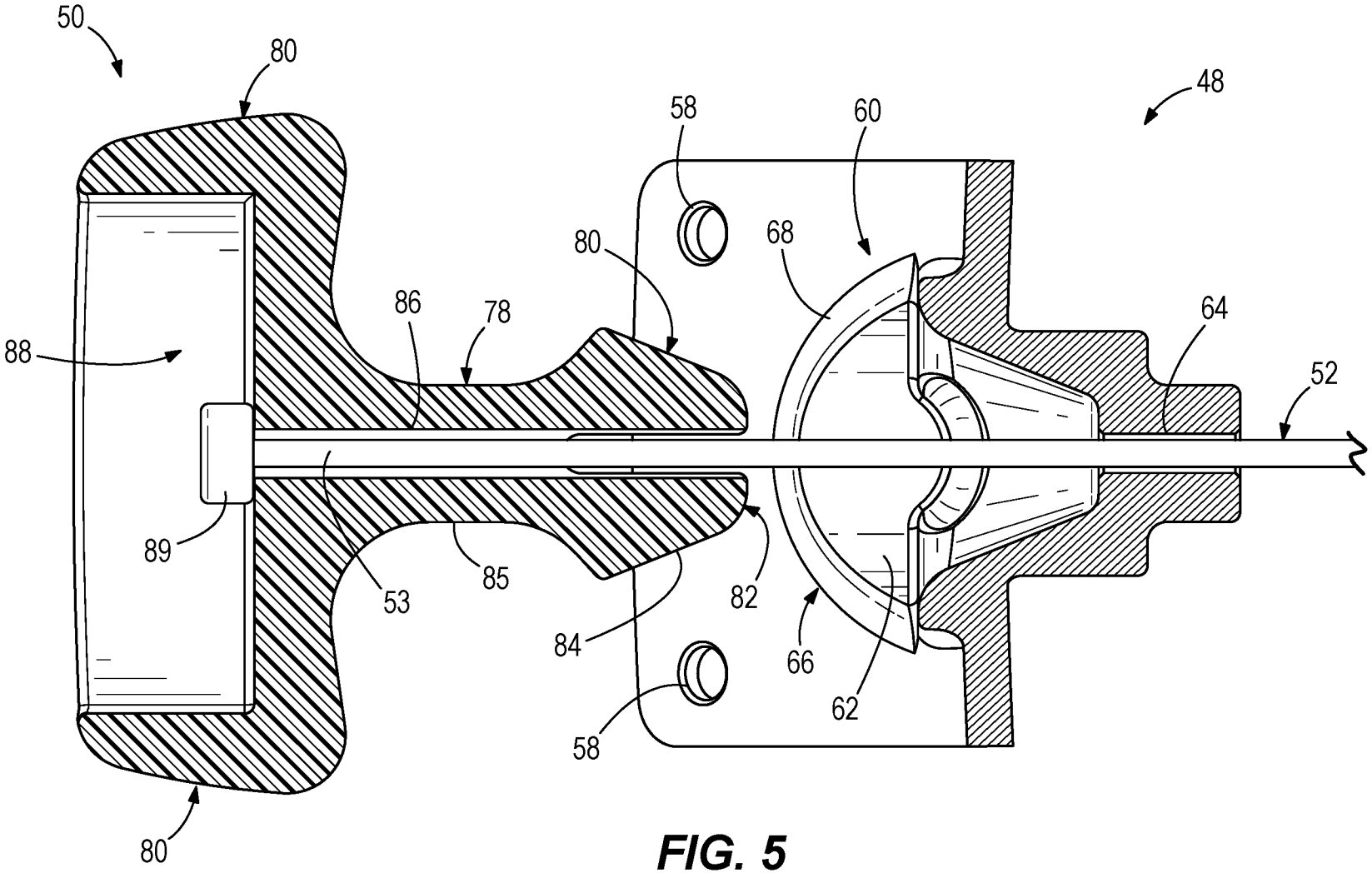
FIG. 5 is a view of section 5-5, taken in FIG. 3.
Figure 6:
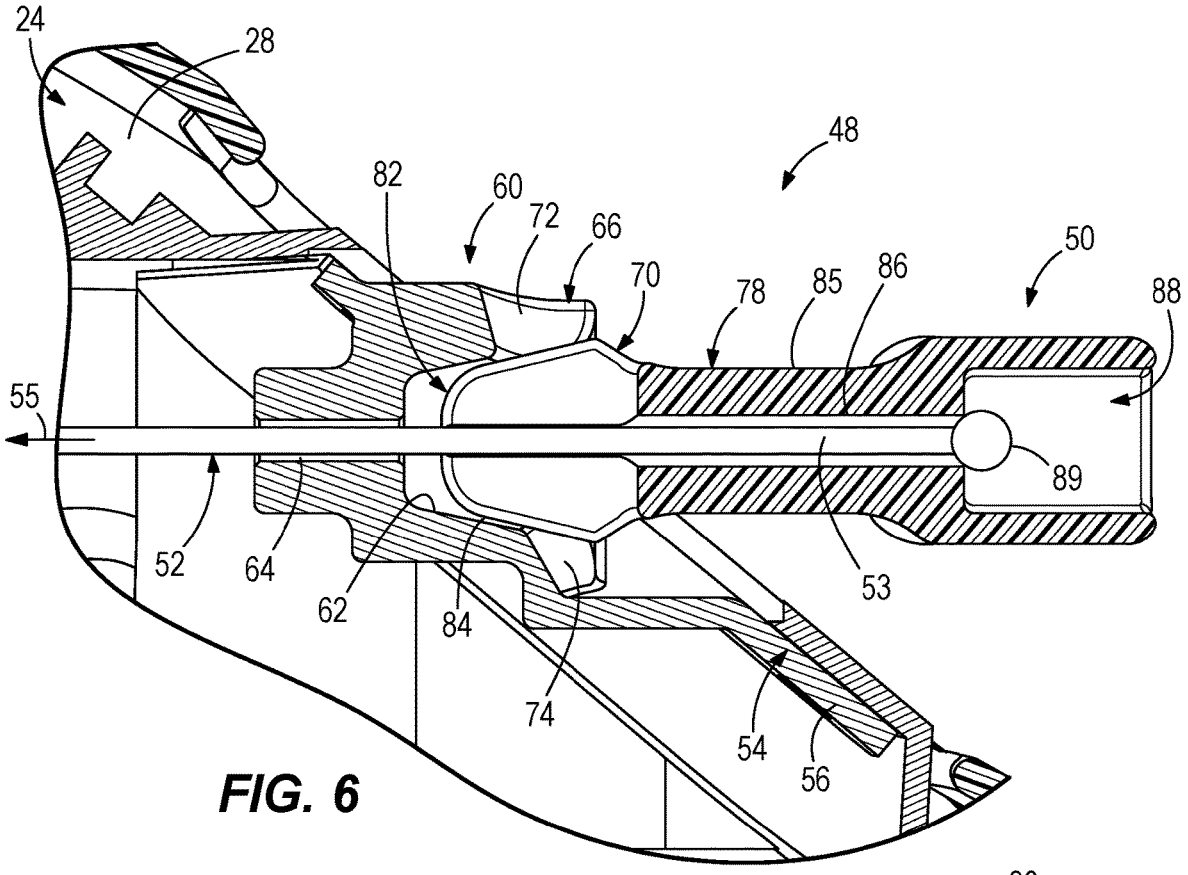
FIG. 6 is a view of section 6-6, taken in FIG. 2.
Figure 7:
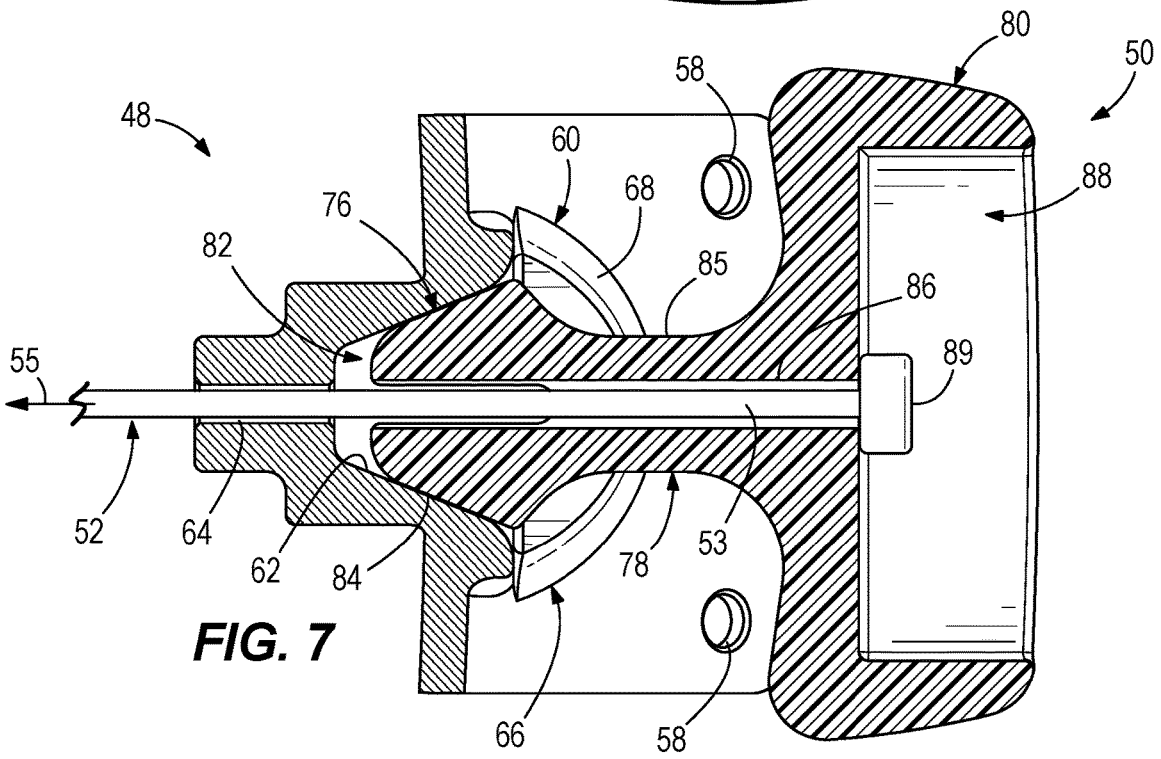
FIG. 7 is a view like FIG. 5, illustrating the recoil starter in a recoiled position.

Referring now to FIGS. 3-5, the recoil starter 48 has a base 54 in which the pull-start handle 50 is normally seated when the upper cowl portion 28 is positioned in the closed cowl position and the pull-start handle 50 is recoiled. More particularly, the base 54 has a base plate member 56, which in the illustrated example is fixed to the powerhead 22. The manner and location where the base plate member 56 is mounted can vary from what is shown. In the illustrated example, holes 58 are formed through the base plate member 56, through which removable fasteners can be inserted and connected in threaded engagement to the powerhead 22 or other component of the outboard motor 20. The base 54 has a seat 60 configured to receive and retain the pull-start handle 50 in its recoiled position, as shown in FIGS. 6 and 7. The seat 60 has a radially inner surface 62 having an oblong, and generally conical shape. A through-bore 64 axially extends through base 54 in the seat 60. The through-bore 64 is surrounded by the radially inner surface 62. The recoil cable 52 extends from the noted recoil mechanism, through the through-bore 64 and into connection with the pull-start handle 50. The seat 60 has an outer perimeter surface 66 extending circumferentially around the radially inner surface 62. The outer perimeter surface 66 has diametrically opposing funnel portions 68 that generally lead into the oblong, conical shape of the radially inner surface 62. The outer perimeter surface 66 further has diametrically opposing cutout portions that are interdigitated with the funnel portions 68 and that facilitate tilting of the pull-start handle 50 with respect to the seat 60 into an offset position, as will be further explained herein below. In particular, the diametrically opposing cutout portions include a first cutout portion providing a shoulder 72 and a second cutout portion providing a diametrically opposing shoulder 74. The shoulders 72, 74 have different physical configurations, respectively, as will be further described herein below.

Referring to FIGS. 3-7, the pull-start handle 50 is configured to seat or nest in the seat 60 in a generally horizontal orientation when the pull-start handle 50 is recoiled by the recoil mechanism. The pull-start handle 50 has a head 76, a body 78 that axially extends from the head 76, and arms 80 that transversely extend from the body 78 and are configured for manual grasping by the user. The shape and configuration of the pull-start handle 50 can vary from what is shown. In the illustrated example, the head 76 has an axially outer end 82 and a radially outer surface 84 extending away from the axially outer end 82 and having an oblong, and generally conical shape. The body 78 has a generally cylindrical shape with a smooth cylindrically-shaped outer surface 85. The body 78 and the arms 80 form a T-shape. As shown in the figures, the radially outer surface 84 is thus configured to abut the radially inner surface 62 of the seat 60 when the pull-start handle 50 is in the nested, recoiled position. The oblong shapes of the radially inner and outer surfaces 62, 84 cause the pull-start handle 50 to automatically seat in the generally horizontal orientation shown FIG. 6 when the pull-start handle 50 is recoiled by the recoil mechanism. Thus it will be understood that oblong, conical shapes of the radially inner and outer surfaces 62, 84 are configured to consistently guide the head 76 into the seat 60 and into the orientation shown in FIG. 6 when the pull-start handle 50 recoiled under the noted recoil force of the recoil mechanism, which is continuously applied to the pull-start handle 50 via the recoil cable 52, as described herein above. The body 78 connects the head 76 to the arms 80 and has a smaller outer diameter than the outermost extent of the head 76. A through-bore 86 axially extends through the head 76 and body 78 to a recess 88 formed in the arms 80. The through-bore 86 extends through the axially outer end 82. The second end 55 of the recoil cable 52 extends into the through-bore 86 and has an enlarged cable end 89 disposed in the recess 88 and engaging interior bearing surfaces in the recess 88, which thereby secures the recoil cable 52 to the pull-start handle 50.

Figure 8:
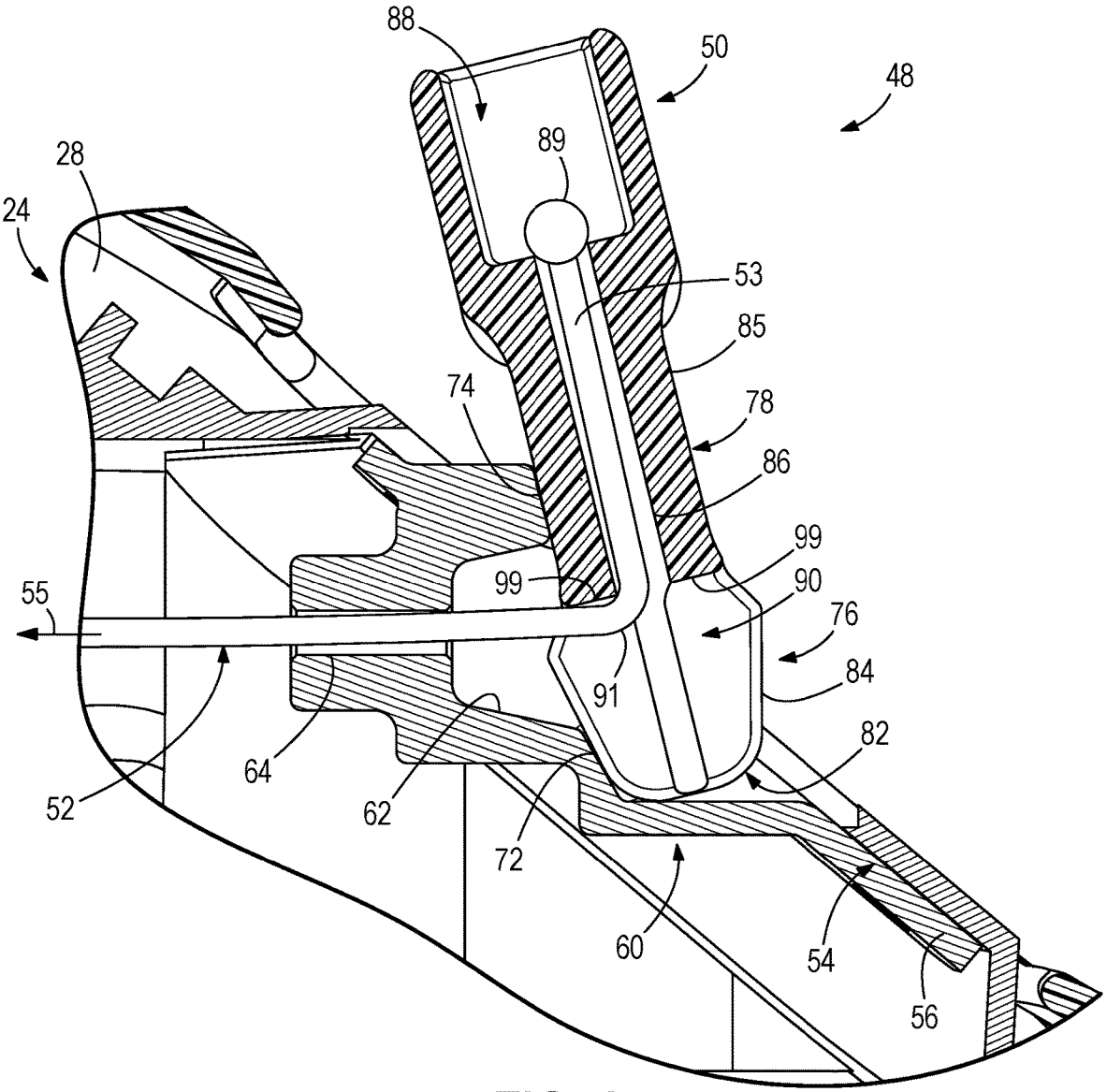
FIG. 8 is a view like FIG. 6, illustrating the recoil starter in an offset position.

The pull-start handle 50 is further movable out of the recoiled position shown in FIGS. 6 and 7 into an offset position shown in FIG. 8. In this position, the head 76 is unseated from the seat 60 and supported by the shoulder 72 against the recoil force of the recoil cable 52. The body 78 is supported by the opposing shoulder 74. As shown in FIG. 8, the shoulder 72 is offset from the opposing shoulder 74 so that the pull-start handle 50 is maintained at a tilted orientation relative to seat 60 by the recoil force of the recoil mechanism. In particular, the shoulder 72 has a planar outer profile that is set at an angle so as to align with and be abutted by the radially outer surface 84 of the head 76 when the pull-start handle 50 is in the illustrated offset position. Further, the shoulder 74 has a planar outer profile that is set at an angle so as to align with and be abutted by the generally cylindrically-shaped outer surface of the body 78 when the pull-start handle 50 is in the illustrated offset position. Tilting of the pull-start handle 50 into the offset position with respect to the recoil cable 52 is also facilitated by a radial slot 90 in the head 76. The radial slot 90 extends from the through-bore 86, and extends axially along at least a portion of the head 76 from the axially outer end 82. Thus the recoil cable 52 can bend transversely out of the through-bore 86 via the radial slot 90, as shown at bend 91, as it axially slides along the radial slot 90 when the pull-start handle 50 is pivoted from the recoiled position shown in FIGS. 6 and 7 to the offset position shown in FIG. 8. The recoil cable 52 can slide along the axial length of the head 76 until it reaches the axially inner-most end 99 of the radial slot 90, as shown in FIG. 8. This facilitates tilting of the pull-start handle 50 relative to the recoil cable 52 and also with respect to the seat 60.

Referring now to FIG. 2, the upper cowl portion 28 has an opening 92 through which the pull-start handle 50 extends. The opening 92 is located along upper portion of the forward side 42 of the outboard motor 20, thus facilitating manual operation by a user located in the associated marine vessel. The opening 92 has upper and lower borders 94, 96 and opposing side borders 98, which together define an outer extent of the opening that extends around the pull-start handle 50, seat 60 and portions of the base 54. Optionally, one or more seals can be located between the interior of the cowling 24 along the borders 94, 96, 98 to prevent ingress of water to the interior of the cowling 24 when the upper cowl portion 28 is in the closer position shown in FIG. 2.

As further described with reference to FIG. 9-13, the cowling 24 and recoil starter 48 are thus advantageously and uniquely configured to overcome the disadvantages of the above-described prior art, for example such that movement of the upper cowl portion 28 from the closed cowl position to the open cowl position when the pull-start handle 50 is in the recoiled position causes the pull-start handle 50 to move into and remain in the offset position, thus permitting subsequent movement of the upper cowl portion 28 back into the closed cowl position with less steps undertaken by the user. The cowling 24 and recoil starter 48 are uniquely configured such that when the pull-start handle 50 is in the offset position, the upper cowl portion 28 is freely movable into and between the open and closed cowl positions.

Figure 9:
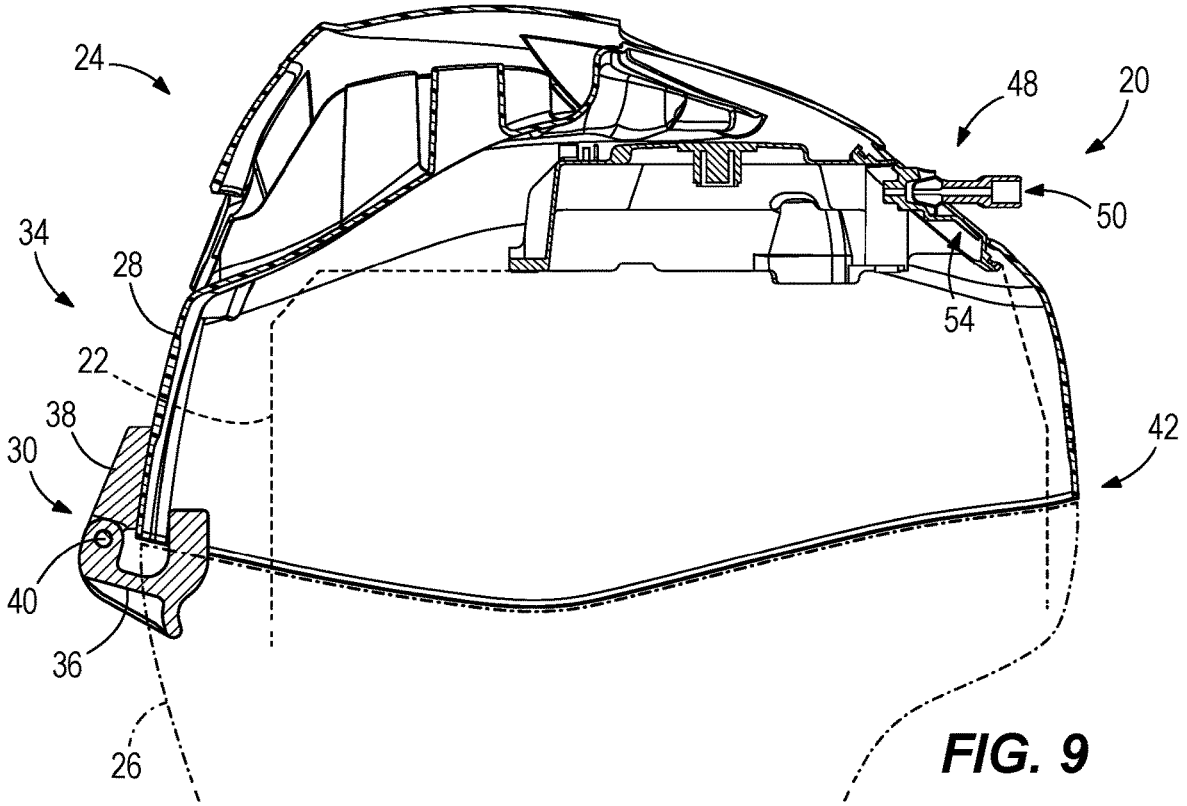
FIG. 9 is a sectional view of the outboard motor, illustrating the first and second cowling portions in a closed cowl position.

FIG. 9 illustrates the outboard motor 20 during typical use conditions, wherein the upper cowl portion 28 is located in the above-described closed cowl position, thus enclosing the powerhead 22 in the cowling 24. In this position, the pull-start handle 50 is seated in the seat 60 and extends through the opening 92 in the upper cowl portion 28, thus facilitating manual operation by a user in the associated marine vessel. In this position, the above-noted latching mechanism is also manually operable by the user to unlatch the upper cowl portion 28 from the lower cowl portion 26.

Figure 10:
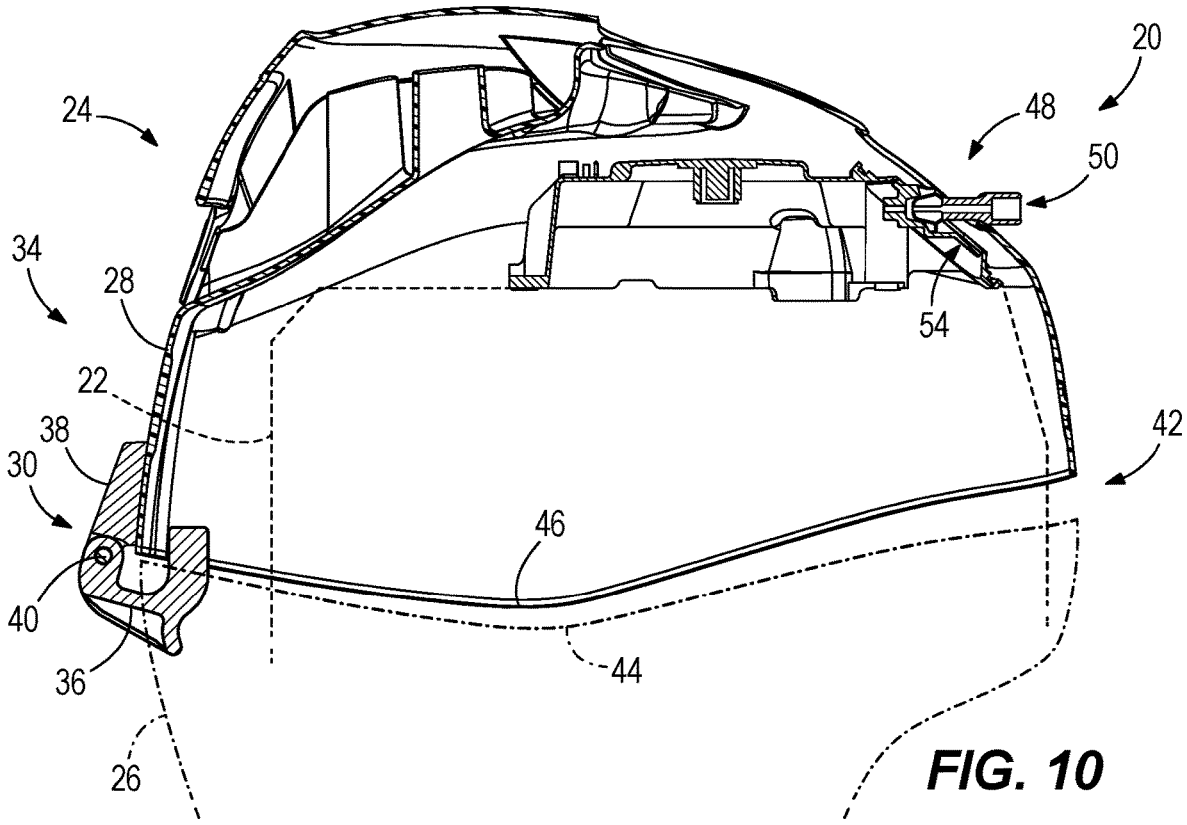
FIG. 10 is a view like FIG. 9, illustrating movement of the upper cowl portion out of the closed cowl position.

FIG. 10 illustrates the outboard motor 20 upon opening of the noted latching mechanism. Usually the upper cowl portion 28 is clamped onto the lower cowl portion 26 via the hinge mechanism 30, the profiles of the respective upper and lower perimeters 44, 46, and the noted latching mechanism and under a torque force or "preload" such that when the latching mechanism is unlatched the upper cowl portion 28 pivots upwardly about the pivot axis as shown. In this position, the opening 92 is sized large enough so that the lower border 96 of the opening 92 does not engage or interfere with the pull-start handle 50, which as shown in still protruding through the opening 92.

Figure 11:
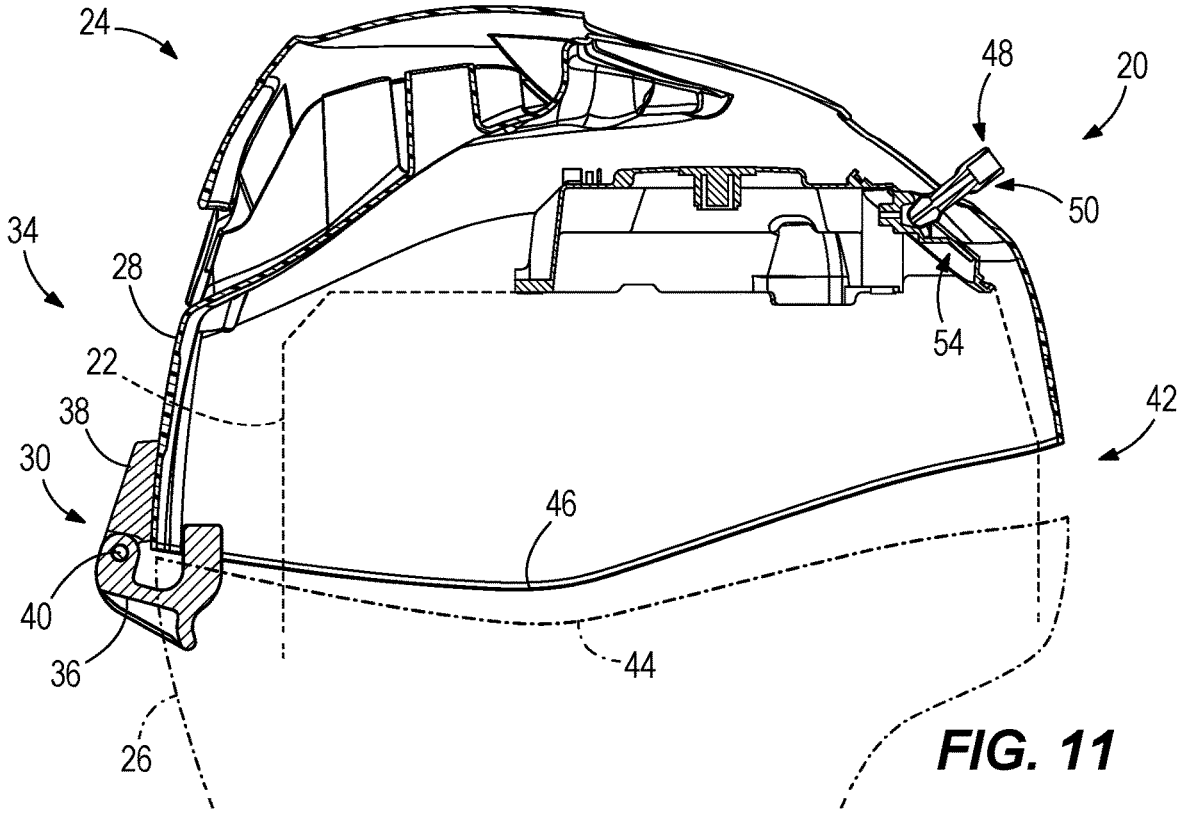
FIG. 11 is a view like FIG. 10, illustrating further movement of the upper cowl portion.

FIG. 11 illustrates the outboard motor 20 once latching mechanism is unlatched and the user has begun to manually pivot the upper cowl portion 28 about the pivot axis. As shown, this brings the lower border 96 of the opening 92 on the upper cowl portion 28 into contact with the outer surface 85 of the body 78 and thereby causes the pull-start handle 50 to pivot within and with respect to the seat 60. At this point, the head 76 is still seated or nested in the seat 60. Pivoting of the pull-start handle 50 with respect to the recoil cable 52 is facilitated by sliding of the recoil cable 52 downwardly from the axially outer end 82 via the radial slot 90, as described herein above with respect to FIG. 8.

Figure 12:
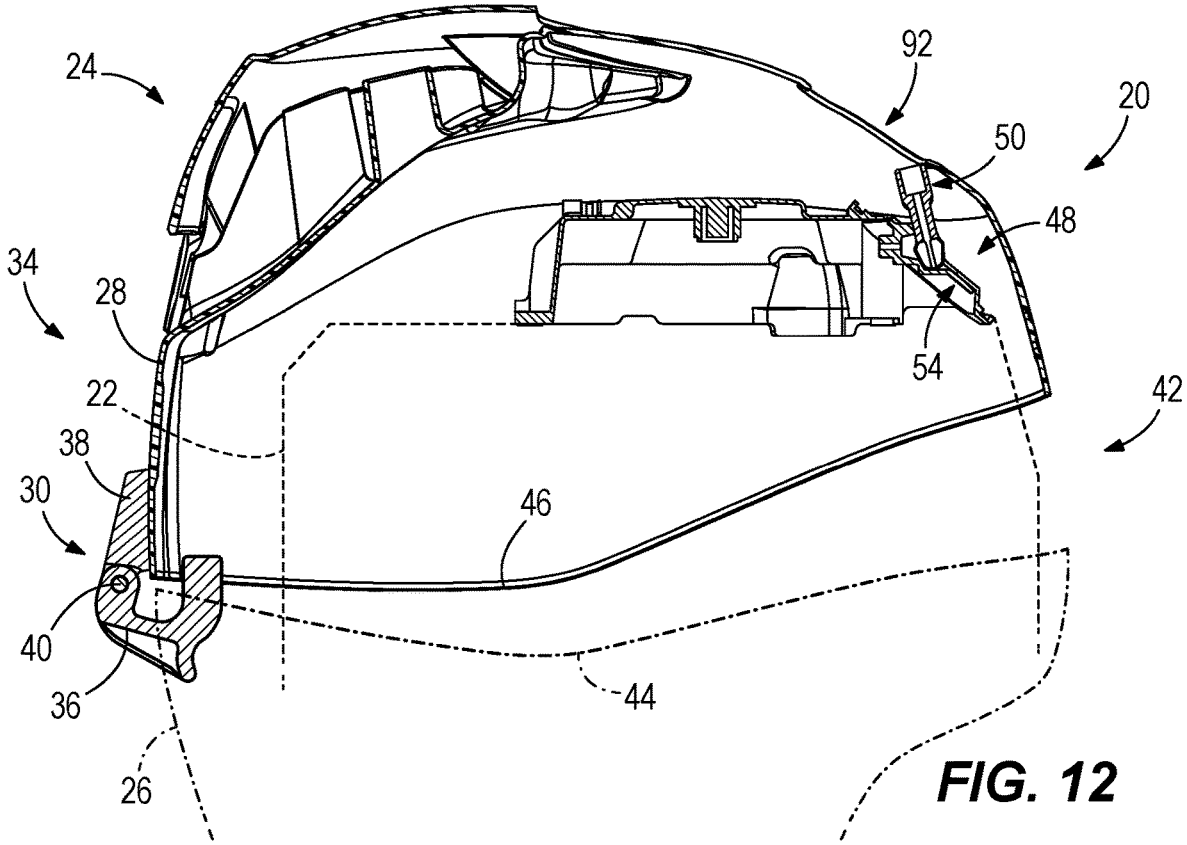
FIG. 12 is a view like FIG. 11, illustrating further movement of the upper cowl portion.
Figure 13:
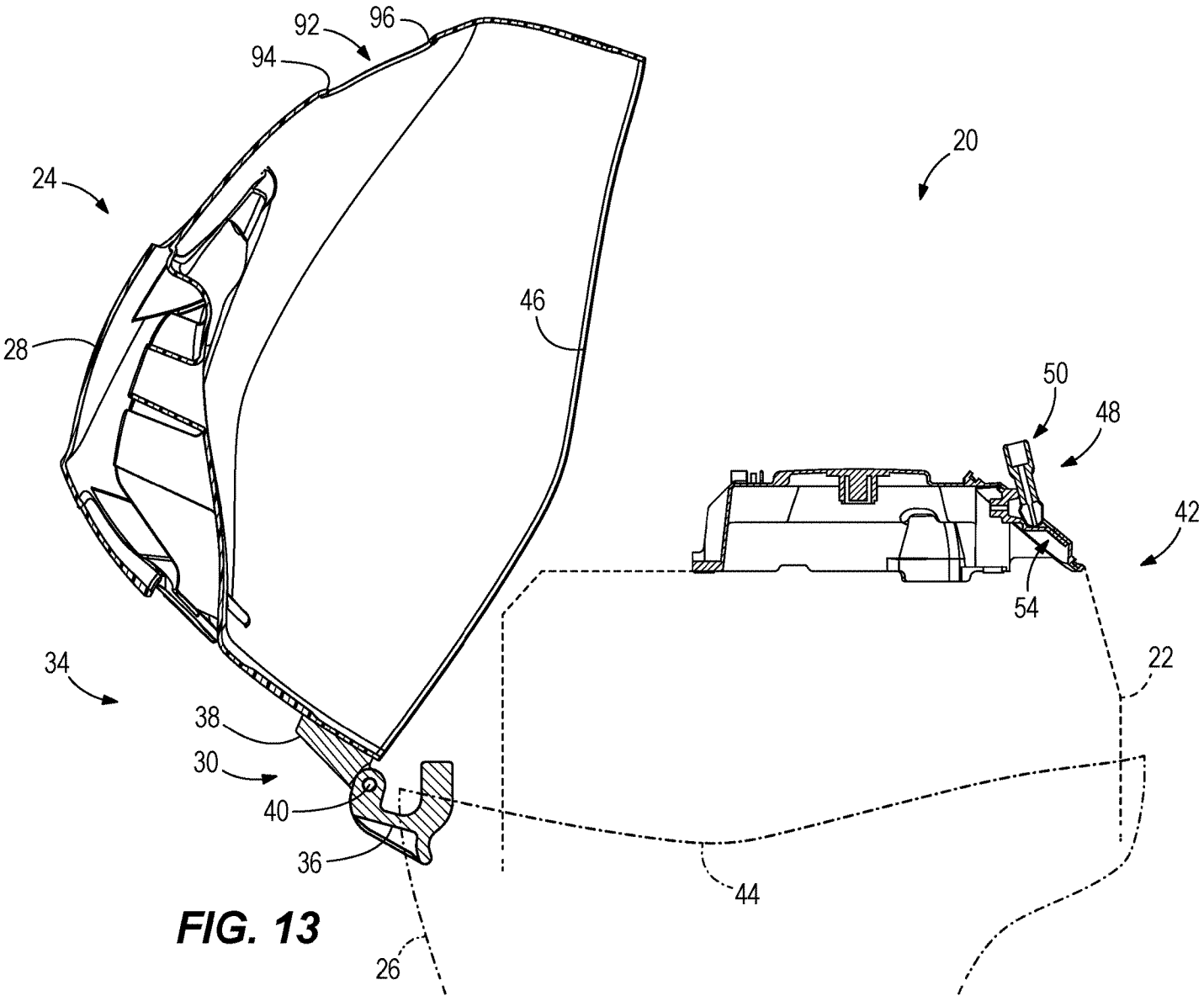
FIG. 13 is a view like FIG. 13, illustrating the upper cowl portion in an open cowl position.

FIG. 12 illustrates the outboard motor 20 during continued pivoting of the upper cowl portion 28 relative to what is shown in FIG. 11. As the upper cowl portion 28 is pivoted about the pivot axis, the lower border 96 of the opening 92 continues to pivot the pull-start handle 50 towards and into the offset position shown in FIGS. 12 and 13 (see also FIG. 8). In particular, the lower border 96 first engages the outer surface 85 of the body 78 and slides upwardly along the outer surface 85 and along the front or rear surface 95 of the arms 80 until the pull-start handle 50 is fully pivoted into the offset position, at which point the lower border 96 passes by the pull-start handle 50 as the upper cowl portion 28 is pivoted towards the position shown in FIG. 13, leaving the pull-start handle 50 in the illustrated offset position. Pivoting of the pull-start handle 50 is facilitated by sliding of the recoil cable 52 along the radial slot 90 until it engages with the axially inner-most end 99 of the radial slot 90, as described herein above. Thus the cowling 24 and recoil starter 48 are advantageously configured to facilitate an easy movement of the upper cowl portion 28 into the open cowl position without requiring the user to interact with the recoil starter 48.

Referring to FIG. 13, the cowling 24 and recoil starter 48 are also configured so that the upper cowl portion 28 can be pivoted back into the closed cowl position after the above-described sequence. More specifically, once the pull-start handle 50 is pivoted into the offset position, it is retained so that it remains in that position, particularly by the recoil force of the recoil cable 52, which is bent across the axially inner-most end 99 of the radial slot 90, as shown in FIG. 8. Specifically, the recoil force pulls the head 76 and body 78 against the shoulder 72 and opposing shoulder 74, respectively, as described herein above with reference to FIG. 8. The opening 92 is sized large enough so that the upper cowl portion 28 can be moved from the open cowl position shown in FIG. 13 to the lower cowl position shown in FIG. 8 without engaging and/or dislodging the pull-start handle 50 from the offset position. Once the upper cowl portion 28 is moved back into the closed cowl position, the pull-start handle 50 can be easily manually flipped from the offset position back into the recoiled position by the user located in the marine vessel, thus facilitating operation of the recoil starter 48.

It will thus be seen that the present disclosure provides novel configurations for a marine drive, and in the particular illustrated example, novel configurations for a cowling and a recoil starter, which for example can be utilized on an outboard motor.

In the illustrated example, the marine drive has a powerhead; a cowling enclosing the powerhead; and recoil starter for staring the marine drive. The cowling has a first cowl portion and a second cowl portion coupled to the first cowl portion and being has with respect to the first cowl portion into and between a closed cowl position in which the powerhead is enclosed by the cowling and an open cowl position in which the powerhead is accessible. The recoil starter extends through the second cowl portion and has a pull-start handle coupled to the marine drive via a recoil cable. Manually pulling the pull-start handle out of a recoiled position with respect to the marine drive causes the marine drive to start. The pull-start handle is also movable out of the recoiled position into an offset position, in which the second cowl portion is freely movable into and out of the open and closed cowl positions. Movement of the second cowl portion from the closed cowl position to the open cowl position when the pull-start handle is in the recoiled position causes the pull-start handle to move into and remain in the offset position, thus permitting subsequent movement of the second cowl portion back into the closed cowl position. The pull-start handle is manually movable from the offset position back to the recoiled position after the second cowl portion has been moved back into the closed cowl position.

In certain examples, the second cowl portion is coupled to the first cowl portion by a hinge mechanism, wherein the second cowl portion is moved from the closed cowl position by pivoting the second cowl portion about the hinge mechanism. The pull-start handle has a head and the recoil starter further has a seat. The head is seated in the seat when the pull-start handle is in the recoiled position. The head is unseated from the seat when the pull-start handle is in the offset position. The head has a radially outer surface which abuts a radially inner surface on the seat when the pull-start handle is in the recoiled position. The radially inner and outer surfaces are conical and guide the head into the seat when the pull-start handle is allowed to recoil under a recoil force applied on the pull-start handle via the recoil cable.

The recoil starter further has a shoulder which is engaged by the head so as to retain the pull-start handle in the offset position when the second cowl portion is moved out of the open cowl position. A recoil force is applied on the pull-start handle via the recoil cable, wherein the recoil force retains the pull-start handle in the seated position, and alternately wherein the recoil force pulls the head onto the shoulder and thus retains the pull-start handle in the offset position. The pull-start handle further has a body, and wherein movement of the second cowl portion from the closed cowl position engages the body and thereby moves the pull-start handle from the recoiled position to the offset position. The shoulder is located adjacent to the seat and further comprising an opposing shoulder located on an opposite side of the seat, wherein the shoulder and the opposing shoulder support the head and the body, respectively, against the recoil force when the pull-start handle is in the offset position.

The cowling defines an opening through which the pull-start handle extends, and wherein movement of the second cowl portion from the closed cowl position causes the second cowl portion to engage and thereby tilt the pull-start handle into the offset position. The opening is sized large enough to permit the second cowl portion to move from the open cowl position to the closed cowl position when the pull-start handle is in the offset position. The pull-start handle in the offset position can pass through the opening as the second cowl portion is moved into the closed cowl position.

The head has an axially outer end and wherein the recoil cable extends from the axially outer end and into an axial through-bore in the seat, and further comprising a radial slot in the head, which is configured such that the recoil cable can translate along the axial slot when the second cowl portion moves the pull-start handle, thus facilitating tilting of the pull-start handle with respect to the recoil cable and with respect to the seat, from the recoiled position to the offset position.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A marine drive comprising:

a powerhead;

a cowling enclosing the powerhead, the cowling comprising a first cowl portion and a second cowl portion coupled to the first cowl portion and being movable with respect to the first cowl portion into and between a closed cowl position in which the powerhead is enclosed by the cowling and an open cowl position in which the powerhead is accessible; and a recoil starter for starting the marine drive, wherein the recoil starter extends through the second cowl portion and comprises a pull-start handle coupled to the marine drive via a recoil cable, and wherein manually pulling the pull-start handle out of a recoiled position with respect to the marine drive causes the marine drive to start;

wherein the pull-start handle is also movable out of the recoiled position into an offset position, in which the second cowl portion is freely movable into and out of the open and closed cowl positions, and wherein movement of the second cowl portion from the closed cowl position to the open cowl position when the pull-start handle is in the recoiled position causes the pull-start handle to move into and thereafter remain in the offset position, thus permitting subsequent movement of the second cowl portion back into the closed cowl position.

2. The cowling according to claim 1, wherein the pull-start handle is manually movable from the offset position to the recoiled position when the second cowl portion has been moved back into the closed cowl position.

3. The cowling according to claim 1, wherein the second cowl portion is coupled to the first cowl portion by a hinge mechanism, wherein the second cowl portion is movable out of the closed cowl position by pivoting the second cowl portion about the hinge mechanism.

4. The cowling according to claim 1, wherein the recoil starter further comprises a seat and wherein the pull-start handle comprises a head that is seated in the seat when the pull-start handle is in the recoiled position, and further wherein the head is unseated from the seat when the pull-start handle is in the offset position.

5. The cowling according to claim 4, wherein the head comprises a radially outer surface that abuts a radially inner surface of the seat when the pull-start handle is in the recoiled position.

6. The cowling according to claim 5, wherein the radially inner and outer surfaces are conical and guide the head into the seat when the pull-start handle recoiled into the recoiled position.

7. The cowling according to claim 4, wherein the recoil starter further comprises a shoulder which is engaged by the head so as to retain the pull-start handle in the offset position when the second cowl portion is moved out of the open cowl position.

8. The cowling according to claim 7, wherein a recoil force is applied on the pull-start handle via the recoil cable, wherein the recoil force retains the pull-start handle in the seated position, and wherein the recoil force retains the pull-start handle in the offset position.

9. The cowling according to claim 8, wherein the pull-start handle further comprises a body, and wherein movement of the second cowl portion from the closed cowl position causes the second cowl portion to engage the body and thereby move the pull-start handle from the recoiled position to the offset position.

10. The cowling according to claim 9, wherein the shoulder is located adjacent to the seat and further comprising an opposing shoulder located on an opposite side of the seat, wherein the shoulder and the opposing shoulder support the head and the body, respectively, against the recoil force when the pull-start handle is in the offset position.

11. The cowling according to claim 4, wherein the cowling defines an opening through which the pull-start handle extends, and wherein movement of the second cowl portion from the closed cowl position causes the second cowl portion to engage and thereby tilt the pull-start handle into the offset position.

12. The cowling according to claim 11, wherein the opening is sized large enough to permit the second cowl portion to move from the open cowl position to the closed cowl position when the pull-start handle is in the offset position.

13. The cowling according to claim 11, wherein the pull-start handle in the offset position can pass through the opening as the second cowl portion is moved into the closed cowl position.

14. The cowling according to claim 4, wherein the head comprises an axially outer end and wherein the recoil cable extends from the axially outer end and into an axial through-bore in the seat, and further comprising a radial slot in the head, which is configured such that the recoil cable can translate along the axial slot when the second cowl portion moves the pull-start handle, thus facilitating tilting of the pull-start handle with respect to the recoil cable and with respect to the seat, from the recoiled position to the offset position.

15. The cowling according to claim 14, wherein the recoil starter further comprises a shoulder which is engaged by the head so as to retain the pull-start handle in the offset position, and wherein a recoil force is applied on the pull-start handle via the recoil cable, which pulls the head onto the shoulder and thus retains the pull-start handle in the offset position.

16. The cowling according to claim 1, wherein the second cowl portion is coupled to the first cowl portion by a hinge mechanism, wherein the second cowl portion is moved from the closed cowl position by pivoting the second cowl portion about the hinge mechanism, and wherein the pull-start handle comprises a head, wherein the recoil starter further comprises a seat, wherein the head is seated in the seat when the pull-start handle is in the recoiled position, and further wherein the head is unseated from the seat when the pull-start handle is in the offset position.

17. The cowling according to claim 16, wherein the head comprises a radially outer surface which abuts a radially inner surface on the seat when the pull-start handle is in the recoiled position.

18. The cowling according to claim 17, wherein the radially inner and outer surfaces are conical and guide the head into the seat when the pull-start handle is allowed to recoil under a recoil force applied on the pull-start handle via the recoil cable.

19. The cowling according to claim 18, wherein the recoil starter further comprises a shoulder which is engaged by the head so as to retain the pull-start handle in the offset position when the second cowl portion is moved out of the open cowl position.

20. The cowling according to claim 19, wherein a recoil force is applied on the pull-start handle via the recoil cable, wherein the recoil force retains the pull-start handle in the seated position, and alternately wherein the recoil force pulls the head onto the shoulder and thus retains the pull-start handle in the offset position.

* * * * *